US007204896B2

(12) United States Patent
Maunder et al.

(10) Patent No.: US 7,204,896 B2
(45) Date of Patent: Apr. 17, 2007

(54) ELECTRICAL CABLE WITH SELF-REPAIRING PROTECTION AND APPARATUS FOR MANUFACTURING THE SAME

(75) Inventors: Andrew L. Maunder, Greenwood, SC (US); Alberto Bareggi, Milan (IT); Luca Balconi, Bresso (IT); Gaia Dell'Anna, Milan (IT); Giovanni Pozzati, Sens (FR); Sergio Belli, Leghorn (IT)

(73) Assignee: Pirelli Cavi e Sistemi S.p.A., Milan (IT)

( * ) Notice: Subject to any disclaimer, the term of this patent is extended or adjusted under 35 U.S.C. 154(b) by 359 days.

(21) Appl. No.: 10/290,375

(22) Filed: Nov. 8, 2002

(65) Prior Publication Data

US 2003/0051898 A1 Mar. 20, 2003

Related U.S. Application Data

(62) Division of application No. 09/651,276, filed on Aug. 30, 2000, now Pat. No. 6,534,715.

(60) Provisional application No. 60/152,357, filed on Sep. 7, 1999.

(30) Foreign Application Priority Data

Aug. 30, 1999 (EP) ..... 99117013

(51) Int. Cl.
*H01B 7/00* (2006.01)

(52) U.S. Cl. ..... 156/51; 156/47; 156/48

(58) Field of Classification Search ..... 156/47, 156/48, 51; 174/110 R, 116, 120 R, 115
See application file for complete search history.

(56) References Cited

U.S. PATENT DOCUMENTS

| | | | | |
|---|---|---|---|---|
| 2,583,025 | A * | 1/1952 | Swift et al. | 174/117 R |
| 3,595,997 | A | 7/1971 | Krasin | |
| 5,920,032 | A * | 7/1999 | Aeschbacher et al. | 174/47 |
| 5,922,155 | A * | 7/1999 | Clouet et al. | 156/51 |
| 5,990,419 | A * | 11/1999 | Bogese, II | 174/120 R |
| 6,184,473 | B1 * | 2/2001 | Reece et al. | 174/110 R |
| 6,359,231 | B2 * | 3/2002 | Reece et al. | 174/110 R |
| 6,573,456 | B2 * | 6/2003 | Spruell et al. | 174/110 R |
| 6,664,476 | B2 * | 12/2003 | Belli et al. | 174/120 R |
| 2002/0108773 | A1 * | 8/2002 | Ware et al. | 174/120 R |
| 2003/0062188 | A1 * | 4/2003 | Ware et al. | 174/110 R |
| 2003/0168245 | A1 * | 9/2003 | Spruell et al. | 174/120 R |

FOREIGN PATENT DOCUMENTS

| | | |
|---|---|---|
| DE | 1 415 474 | 1/1969 |
| EP | 0 940 819 A1 | 9/1999 |
| FR | 2.085.225 | 12/1971 |
| GB | 2 032 678 A | 5/1980 |

* cited by examiner

*Primary Examiner*—Jeff H. Aftergut
(74) *Attorney, Agent, or Firm*—Finnegan, Henderson, Farabow, Garrett, & Dunner, L.L.P.

(57) ABSTRACT

An electrical cable includes a conductor, an outer sheath, and a self-repairing material layer between the conductor and outer sheath. The self-repairing material layer is distributed around the conductor in a discontinuous manner. An anchor portion is formed between the conductor and the outer sheath.

9 Claims, 4 Drawing Sheets

ELECTRICAL CABLE WITH SELF-REPAIRING PROTECTION AND APPARATUS FOR MANUFACTURING THE SAME

This is a division of application Ser. No. 09/651,276, filed Aug. 30, 2000, now U.S. Pat. No. 6,534,715, and claims the benefit of U.S. provisional application No. 60/152,357, filed Sep. 7, 1999, all of which are incorporated herein by reference.

BACKGROUND OF THE INVENTION

The present invention relates to a cable, in particular a cable for electric power transmission or distribution or for telecommunications. In more detail, the present invention relates to a cable as above defined comprising at least one outer coating sheath and provided with self-repairing protection which is capable of restoring the continuity of the coating sheath after it has been broken.

Electrical cables, in particular low- or medium-voltage cables for the distribution of electric energy for domestic or industrial use, generally consist of one or more conductors individually insulated by a polymeric material and coated with a protective sheath, which is also made of a polymeric material. These cables, in particular when installed underground, either directly or inserted in tunnels or inside buried pipes, are subjected to damages on these layers caused by various types of mechanical abuses, for example accidental impact with sharp tools such as shovels or picks, which exert both cutting and compression actions on the cable, This can lead to partial or complete rupture of the outer sheath and possibly also of the inner insulating layer, which will bring about infiltration of moisture and generation of leakage currents. If rupture of the coating layers reaches the conductor, the combined effect of leakage currents and moisture leads to a gradual corrosion of the conductor until, at the most, a complete breakage of the conductor itself.

To obtain effective protection against such mechanical abuses, the cable can be provided with an outer structure capable of withstanding both cutting and compression, this outer structure consisting of a sheath made of a metal or a plastic material combined with a metal armouring, for example. In addition to being expensive, this solution leads to an important increase in the overall dimensions and rigidity of the cable, thus making this solution unsuitable for cables requiring easy installation and low costs, such as, in particular, in the case of low-voltage cables.

In Patent Application DE-1,590,958 a telecommunications or high-current cable is described which is protected from mechanical damages by means of an outer sheath provided, on its inside, with microcapsules containing a liquid that is capable of rapidly solidifying, once the microcapsule has been broken. To this purpose, use of the two components commonly employed for manufacturing expanded polyurethane is mentioned as the preferred one, these components being microencapsulated separately so that they react together on breaking of the microcapsules, forming an expanded material which closes the accidental cut. Alternatively, liquids solidifying when brought into contact with external agents, moisture for example, may be used.

According to the Applicant, the solution envisaged in the above-mentioned patent application is of difficult practical implementation and has many drawbacks. Firstly it is to note that the possibility of self-repairing is limited to the outer sheath, and no indications regarding the possibility of restoring integrity of the inner insulating layer are provided. In addition, to obtain an effective self-repairing effect, it is necessary to introduce a large amount of microencapsulated material during sheath extrusion, which operation can be rather difficult and also expensive. It is finally to be pointed out that the mechanism of action of the microcapsules is irreversible, so that the self-repairing effect can be carried out only once, i.e. at the moment the microcapsules are broken. Actually, during the various stages of the cable life (manufacturing, storage, installation, use), the coating layers are inevitably subjected to external mechanical actions of compression and bending and to thermal cycles of expansion and compression, which can lead to rupture of the microcapsules with consequent expansion and/or solidification of the material contained therein. This material therefore, will be no longer able to effect the desired self-repairing action when the sheath is actually damaged. It is also to be noted that, even when microcapsules are used which contain a liquid material solidifying on contact with moisture, accidental rupture of the microcapsules without any actual damage to the outer sheath leads in any event to solidification of the material because inside the cable there is always some residual moisture.

The Applicant has now found that, in consequence of a mechanical damage creating a discontinuity in at least one of the cable coating layers, it is possible to obtain effective self-repairing of the coating by virtue of the presence of an inner layer, placed, for example, between the insulating layer and the outer sheath, and comprising a material having a predetermined cohesiveness and at the same time a controlled flowability, which is capable of repairing the damage by restoring the continuity of the coating layer. After a discontinuity in the coating has been created, the material "moves" towards the damaged point and fills up the discontinuity at least partly by forming a substantially continuous layer which is capable of maintaining the cable functionality under the expected working conditions.

The action of the self-repairing material taking place with a reversible mechanism, among other things, prevents moisture infiltration and establishment of leakage currents, and consequently quick corrosion of the conductor.

Based on this starting perception, the Applicant has developed and set up a self-repairing cable and related manufacturing process, being the object of the Patent Application EP 99103092.5, contents of which is considered as herein reported for supplement and completion of the detailed description of the present invention as hereinafter set forth. In accordance with the present invention, the Applicant has now found that by arranging one or more anchoring portions between the outer sheath and the core of the cable, each housed in an interruption region of the self-repairing material extension, further improvements can be advantageously achieved in terms of cable reliability. In particular, any possibility of relative sliding between the outer sheath and inner core of the cable is advantageously eliminated, independently of whether said core is made up of one or more bare conductors or of conductors provided with one or more coating layers internal to the sheath.

In addition, also solved are problems resulting from unsteady positioning of the conductor within the self-repairing material bringing about off-setting of the conductor relative to the cable axis and thickness unevenness in the self-repairing layer itself.

SUMMARY OF THE INVENTION

More particularly, the present invention relates to an electrical cable with self-repairing protection comprising: at least one conductor; at least one outer coating sheath; characterized in that it further comprises: at least one layer of self-repairing material interposed between the conductor and the outer coating sheath, the self-repairing material layer being distributed around the conductor and having at least one region wherein its extension is interrupted; and at least one anchoring portion between the conductor and the outer coating sheath, disposed at said interruption region.

In particular, a plurality of anchoring portions homogeneously distributed around the conductor is preferably provided, each portion being placed at an interruption region of the extension of the layer of self-repairing material.

The layer of self-repairing material is conveniently provided to extend around the conductor following a distribution line along which the ratio between the extension of the self-repairing material layer and the extension of the interruption regions is at least equal to 0.5, and preferably included between 0.5 and 10, more preferably between 0.7 and 2.

The layer of self-repairing material and said at least one anchoring portion can be advantageously disposed directly in contact with the conductor.

In a preferred embodiment, it is however provided that at least one inner coating layer is interposed between the conductor and the layer of self-repairing material.

Each anchoring portion is conveniently directly put into contact with, and possibly joined in one piece to, the inner coating layer.

It is also preferably provided that the anchoring portion or portions should be put directly into contact with, and preferably joined in one piece to the outer coating sheath.

The Applicant has further found convenient for the self-repairing material layer to have a thickness not lower than 0.1 mm.

According to a further aspect, the present invention relates to a method of manufacturing an electrical cable comprising the step of externally applying an outer coating sheath around at least one conductor, characterized in that it further comprises the following steps: applying at least one layer of self-repairing material between the conductor itself and the outer coating sheath; forming at least one interruption region in the extension of said layer of self-repairing material; disposing at least one anchoring portion between the conductor and the outer coating sheath at said interruption region.

In particular, a plurality of said interruption regions homogenously distributed around the conductor is preferably formed and a plurality of anchoring portions are disposed each at one of said interruption regions.

According to a first embodiment of the present invention, the interruption region of the extension of the self-repairing material layer is formed by removing part of the applied self-repairing material from said conductor.

The self-repairing material and anchoring portions can be directly applied to the conductor.

Alternatively, at least one inner coating layer is applied to the conductor before carrying out application of the self-repairing material layer. In this case, the self-repairing material and the anchoring portions are applied directly in contact with the inner coating layer, and possibly accomplished simultaneously, using the same material forming said inner coating layer so as to define one single body on the conductor.

In addition, the anchoring portions are preferably put directly into contact with the outer coating sheath, and possibly manufactured simultaneously with said sheath, to define one single body circumscribing the conductor.

In accordance with a second embodiment of the method in accordance with the present invention, the anchoring portions, the outer coating sheath and the inner coating layer are made of the same coating material, so as to form a unitary body.

Preferably, application of the self-repairing material layer is carried out by injecting the material itself into said coating material, concurrently with the simultaneous accomplishment of the inner coating layer, the anchoring portions and the outer coating sheath.

The present invention also relates to an apparatus for manufacturing electrical cables with self-repairing protection, comprising at least one guide head having at least one inlet opening and at least one outlet opening through which at least one conductor is lengthwise moved; first application devices fed with a coating material and connected to said outlet opening for depositing at least one outer coating sheath around the conductor, characterized in that it further comprises: second application devices operatively associated with the guide head for depositing at least one layer of self-repairing material around the conductor, said second application devices being arranged to define at least one interruption region of the layer extension in the layer of self-repairing material.

In accordance with a first preferred embodiment, the second application devices comprise: at least one storage chamber for the self-repairing material located in the guide head between said inlet opening and outlet opening, said storage chamber and said self-repairing material being passed through by the conductor moving towards the outlet opening; at least one extrusion tip disposed at said outlet opening and arranged to remove at least part of the self-repairing material layer from the conductor to define said at least one interruption region.

In more detail, the extrusion tip preferably has one or more forming teeth homogeneously distributed around the conductor, which act in abutment relationship relative to the conductor to form said interruption region, each forming tooth having at least one conveying surface converging towards the conductor in the feeding direction of the latter so as to delimit, in the first application devices, at least one application channel so as to bring part of said coating material to said interruption region.

In a further preferred solution, the second application devices comprise at least one dispensing nozzle fed with the self-repairing material and operatively associated with said first application devices to inject the self-repairing material into the coating material flowing towards the outlet opening.

BRIEF DESCRIPTION OF THE DRAWINGS

Further features and advantages will be more apparent from the detailed description of some preferred but non-exclusive embodiments of an electric cable with self-repairing protection and an apparatus for accomplishment of the same, following a method in accordance with the present invention. Such a description will be set forth hereinafter with reference to the accompanying drawings, given only for illustrative and thus non-limiting purposes, in which.

DETAILED DESCRIPTION OF THE PREFERRED EMBODIMENTS

Figure 1:
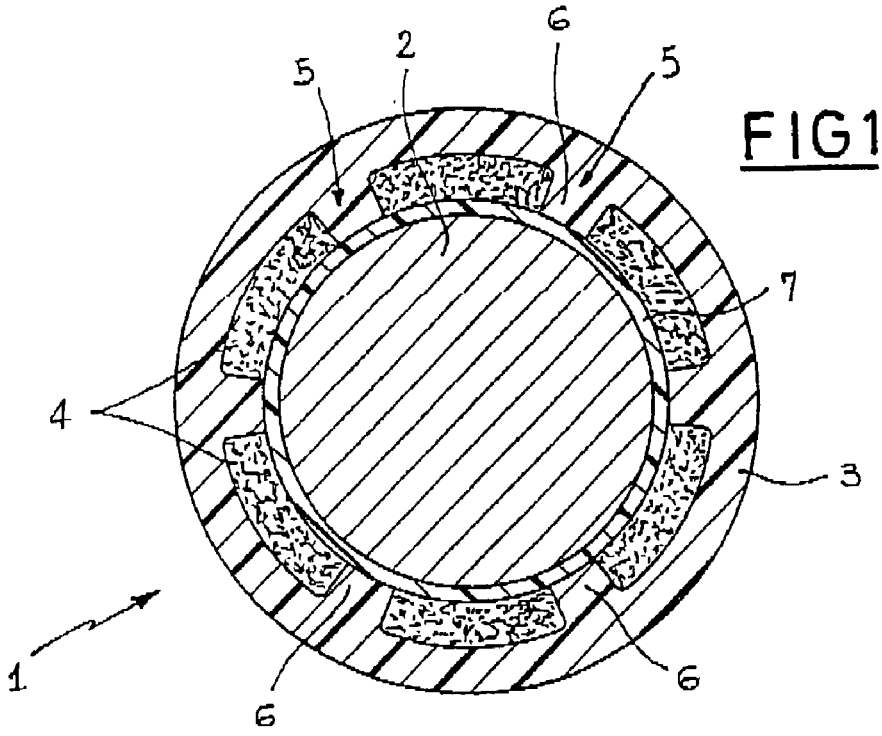
FIG. 1 shows the cross-section of an electrical cable according to a first embodiment of the present invention.

With reference to the drawings, an electrical cable with self-repairing protection in accordance with the present invention has been generally identified by reference numeral 1.

Figure 2:
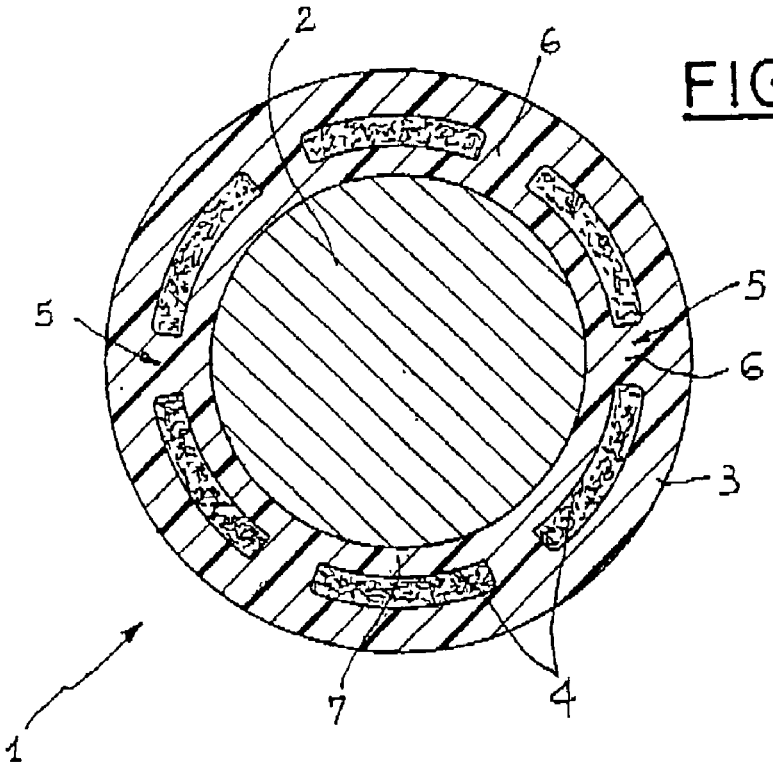
FIG. 2 shows the cross-section of an electrical cable in accordance with a second embodiment.

As shown in FIGS. 1 and 2, the electrical cable 1 comprises at least one conductor 2 which is generally made up of metal wires, preferably copper or aluminium wires, stranded following conventional techniques.

The electrical cable 1 further comprises at least one outer coating sheath 3 in engagement with conductor 2 and at least one layer of self-repairing material 4 interposed between the conductor 2 and the outer coating sheath 3.

The layer of self-repairing material 4 is distributed around the conductor or conductors in a substantially homogeneous manner, in a thickness not less than 0.1 mm, preferably included between 0.2 and 2 mm. More preferably, thickness of the self-repairing material layer 4 is included between 0.3 and 1 mm.

The layer of self-repairing material 4 has at least one region of interruption 5 of its extension, at which at least one anchoring portion 6 is disposed between conductor 2 and the insulating coating sheath 3.

In more detail, as clearly shown in FIGS. 1 and 2, the layer of self-repairing material 4 preferably has a plurality of interruption regions 5 homogeneously distributed around the conductor 2, a respective anchoring portion 6 being disposed at each interruption region 5.

In both embodiments shown, the anchoring portions 6 are formed of one piece construction with the outer coating sheath 3 and are made of the same material. Alternatively, each of the anchoring portions may be provided to be made as a separate component from the outer coating sheath 3 and preferably put directly into contact with said sheath, as well as the self-repairing material layer 4.

To ensure in any event intervention of the self-repairing material when an accidental damage of the cable occurs, the whole space occupied by the self-repairing material layer 4 around conductor 2 preferably is not less than a predetermined value.

In this connection, the ratio of the extension of the self-repairing material layer 4 to the overall extension of the interruption regions 5 is preferably at least equal to 0.5, and preferably included between 0.5 and 10, more preferably between 0.7 and 2.

The overall extension of the self-repairing material layer 4 is determined by the sum of the extensions of the individual arcs defined, between the different interruption regions 5, along a circumferential distribution line of the layer itself, circumscribing the conductor or conductors 2 concentrically to the cable 1. Likewise, the overall extension of the interruption regions 5 can be defined as the sum of the arcs subtended by the same interruption regions along the circumferential distribution line of the self-repairing material layer 4 around the conductor or conductors 2.

In addition, it is preferably provided that between the conductor 2 and the layer of self-repairing material 4 at least one inner coating layer 7, preferably made of an electrically insulating material, is interposed.

In a first embodiment shown in FIG. 1, the inner coating layer 7 comprises at least one tape made of insulating material, Mylar® for example, helically wound around, or longitudinally applied to, the conductor 2. Alternatively, the inner coating layer 7 can be applied by extrusion onto the conductor 2. Acting directly in contact with the inner coating layer 7 is the self-repairing material layer 4 and each of the anchoring portions 6.

In accordance with a second embodiment shown in FIG. 2, the inner coating layer 7 is formed of one piece construction with the same material forming the anchoring portions 6 and the outer coating sheath 3, so as to form a single insulating body having the self-repairing material layer 4 incorporated therein.

It is however to be noted that the cable 1 can be also made following other solutions involving interposition of the self-repairing material layer 4 between the conductor 2 and the outer coating sheath 3.

Figure 1A:
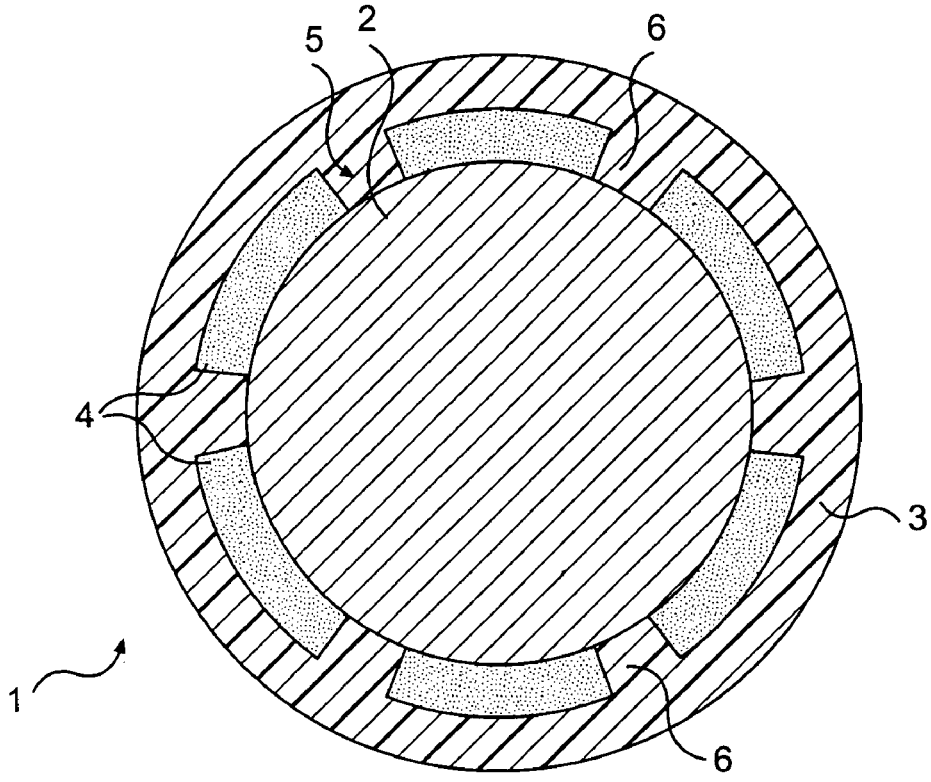
FIG. 1A shows the cross-section of an electrical cable according to a variation of the first embodiment of the present invention.

For example, the conductor may be devoid of any inner coating layer 7. Consequently the layer of self-repairing material 4 and the anchoring portions 6 may be directly in contact with the conductor 2 as illustrated in FIG. 1A.

According to a preferred embodiment of the invention, the anchoring portions 6 have a section of trapezoidal shape with the major base in contact with the inner coating layer 7. This trapezoidal shape allows to increase the area of contact between the anchoring portions 6 and the inner coating layer 7, whilst the overall circumferential extension of the self-repairing material layer 4 at the interface with the outer coating sheath 3 remains substantially unaltered.

In case of possible mechanical abuses on the electrical cable 1, the self-repairing material 4 intervenes ensuring integrity of the damaged cable region to be restored. In more detail, if during installation and/or servicing operations the outer coating sheath is damaged by cuts and/or tears reaching the self-repairing material layer and even beyond, the material therein contained will tend to "move" until it closes said tear or cut.

To this purpose, the self-repairing material 4 is advantageously provided with a predetermined cohesiveness, so that, following creation of a discontinuity in the material itself, due to the action of a cutting tool for example, and once the cause of this discontinuity has been eliminated, the molecules constituting the self-repairing material are capable of spontaneously recreating intermolecular bonds that are sufficient to restore continuity of the material itself.

This phenomenon is of a reversible nature, i.e. the self-repairing material is capable of effectively carrying out its function an indefinite number of times.

It has been found that a cohesive force having values of at least 0.05 kg/cm$^2$ ensures a sufficient cohesiveness of the self-repairing material.

In addition, in the self-repairing materials in accordance with the present invention the re-cohesion force is preferably substantially identical with the cohesive force as above defined, and in any event has a value not lower than 80%, preferably not lower than 90%, with respect to the value of the cohesive force measured on the material as such.

The self-repairing material flowability is to be controlled in such a way as to avoid loss of material either by drainage from the extremities of the cable or by leakage from the point of rupture of the coating, while ensuring the material capability of migrating towards the point of rupture to a sufficient amount to repair the damage.

This flowability control must be ensured both at room temperature and at higher temperatures, for example at the maximum working temperature envisaged for the cable (usually 75–90° C.).

The Applicant has found it convenient to empirically evaluate the flowability of the self-repairing material by a test in which the displacement of a predetermined amount of material placed on an inclined plate at a predetermined temperature and for a predetermined period of time is measured. This test is described in the technical specification ST/LAB/QFE/06, §5.5, established by France Telecom/CNET (release: January 1994).

In compliance with the above test, it is preferably provided that flowability of the self-repairing material is such that a sample of about three grams of self-repairing material, put on an aluminium plate inclined at 60° relative to a horizontal plane and maintained at 60° C. for twenty-four hours, would show a displacement of the front of the material along the inclined plate included between 0.5 and 400 mm.

In addition, the self-repairing material is preferably a dielectric material, capable of re-establishing electrical insulation of the cable 1. This property is particularly important when a mechanical abuse occurs so as to cause partial or complete breaking of the outer coating sheath 3, i.e. so as to reach the conductor 2. Generally, values of alternating current dielectric strength greater than 15 kV/mm, preferably greater than 20 kV/mm, and resistivity values higher than $10^{14}\Omega\cdot$cm, preferably higher than $10^{16}\Omega\cdot$cm, are sufficient.

Another advantageous feature of the self-repairing material is its capacity to exert an efficient blocking action against external moisture tending to infiltrate the cable through the point of rupture of the coating.

For that purpose, it is appropriate for the self-repairing material to have a low saturation water content, with values, measured at room temperature by Karl-Fisher titration, generally lower than 400 ppm.

On the other hand, in the case an inner coating layer 7 consisting of a material which is crosslinkable via silanes should be provided, it is convenient that the self-repairing material, while absorbing small amounts of moisture, should have a sufficient permeability to water vapour since, as known, crosslinking via silanes takes place in the presence of water.

Preferred values of permeability to water vapour, measured at room temperature according to ASTM E 96, are generally included between $1.2\cdot10^{-7}$ and $8.0\cdot10^{-6}$ g/(cm·hour·mmHg).

A first class of materials suitable for making the self-repairing layer according to the present invention consists of amorphous polymers having properties of high-viscosity liquids or of semi-solids, these polymers being selected, for example, from the following classes of products:

(a) polyisobutene or isobutene copolymers with minor amounts of different $C_4$–$C_{12}$ alpha-olefins;

(b) atactic propylene homopolymers;

(c) silicone rubbers, consisting of linear chains of monomer units of formula —O—$SiR_1$—$R_2$—, in which $R_1$ and $R_2$ are optionally substituted aliphatic or aromatic radicals, such as, for example: dimethylsilicone, methylphenylsilicone, methylvinyl-silicone, silicones containing cyanoacrylic or fluoroalkyl groups, and the like.

The amorphous polymers mentioned above can be used as such or dissolved in a suitable solvent, for example a mineral oil or a synthetic oil, in particular a paraffin oil or a naphthenic oil such as, for example, the oils known by the notations ASTM 103, 104A and 104B. Preferably, low molecular weight products that are homologues of the amorphous polymer can be used as solvents.

In the case where the amorphous polymer is dissolved in a suitable solvent as mentioned above, a thickening agent can advantageously be added to the composition, the main function of this thickening agent being to control flowability, thereby reducing the risk of the self-repairing material uncontrollably leaking from the cable.

Another class of materials which are suitable for forming the self-repairing inner layer according to the present invention consists of solid polymeric materials dispersed in an oily phase.

The oily phase can consist, for example, of:

(a) paraffinic oils or naphthenic oils, for example the oils ASTM 103, 104A or 104B;

(b) polybutene oils with an osmometric average molecular weight of between 400 and 1,300, preferably between 500 and 1,000, which can be obtained by polymerization of $C_4$ olefin mixtures mainly containing isobutene, for example commercial products Napvis® (BP Chemicals) and Indopol® (Amoco);

(c) polypropylene oils;

(d) low molecular weight polyesters, for example acrylic acid polyesters, such as product ECA 7955 from Exxon Chemical Co.;

or mixtures thereof.

For further information as regards composition of the self-repairing material in accordance with the present invention, please refer to that which has already been described in the above-mentioned Patent Application EP 99103092.5, in the name of the same Applicant.

The outer coating sheath 3, the inner coating layer 7, if any, and the anchoring portions 6 can be, in turn, made of a conventional polymeric coating material, crosslinked or not, generally of the polyolefin type, such as polyethylene, polypropylene, ethylene/propylene copolymers, ethylene/propylene/diene terpolymers and the like, or mixtures thereof.

Figure 3:
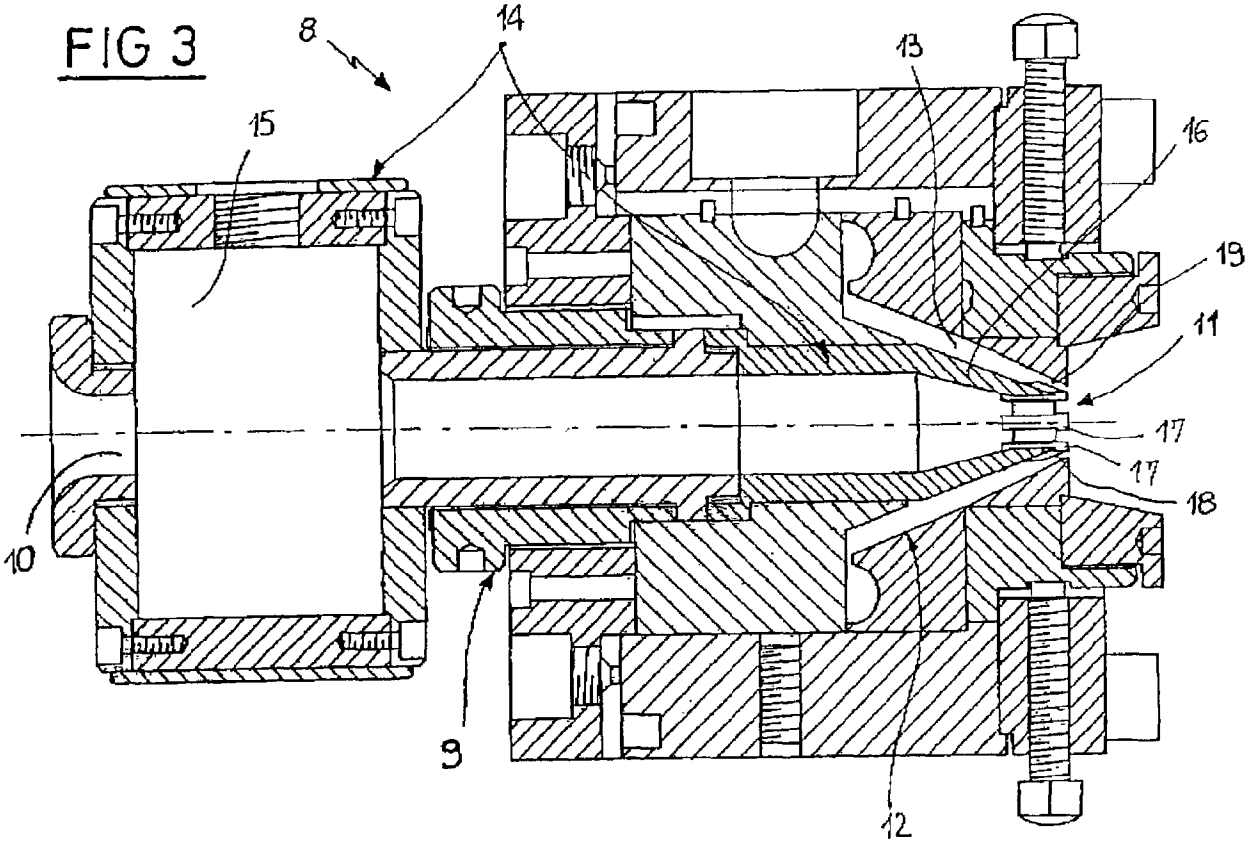
FIG. 3 is a longitudinal section of an apparatus for manufacturing the electrical cable shown in FIG. 1.
Figure 4:
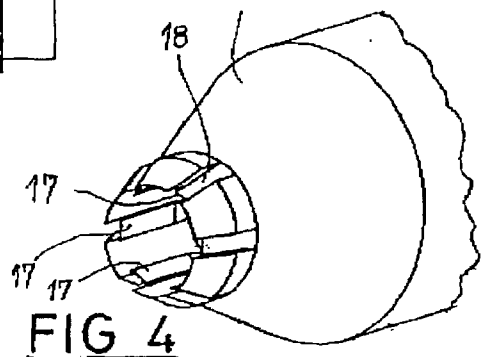
FIG. 4 is an interrupted perspective view illustrating, with an enlarged scale relative to FIG. 3, a construction detail of the apparatus shown in said figure.

An apparatus for manufacturing an electrical cable 1 in accordance with the embodiment shown in FIG. 1 is illustrated with reference to FIG. 3.

The apparatus 8 comprises at least one guide head 9 having at least one inlet opening 10 and at least one outlet opening 11 aligned with each other, through which conductor 2 is fitted, possibly provided with the inner coating layer 7. By pulling devices, not shown as they can be obtained in any manner convenient for a person skilled in the art, the conductor 2 is moved at a constant and controlled speed from the inlet opening 10 to the outlet opening 11. Incorporated into the guide head 9 are first application devices 12 fed with the polymeric coating material and terminating at the outlet opening for depositing the outer coating sheath 3 on the conductor 2. In more detail, the first application devices 12 comprise at least one feed duct 13 extending in an annular form around the outlet opening 11 of the guide head 9. By means of the feed duct 13, the outer coating sheath 3 is uniformly deposited around the whole outer surface of the conductor 2.

The apparatus 8 further comprises second application devices 14 operatively associated with the guide head 9 to deposit the layer of self-repairing material 4 around conductor 2 in the manner shown in FIG. 1, thereby substantially carrying out a pultrusion operation.

To this purpose, the second application devices 14 comprise at least one storage chamber 15 fed with the self-repairing material maintained to a sufficient degree of fluidity, preferably by heating. When conductor 2 is moved through the guide head 9, it also passes through the storage chamber 15 and consequently through the self-repairing material contained therein, which deposits around the whole surface of the conductor 2.

The second application devices 14 further comprise an extrusion tip 16 disposed at the outlet opening 11 of the guide head 9. This extrusion tip 16 distributes the self-repairing material in a predetermined thickness along the conductor 2, so as to form the self-repairing material layer 4, and is provided with one or more forming teeth 17 arranged to remove corresponding parts of the self-repairing material layer 4 from conductor 2, so as to define the above mentioned interruption regions 5.

More specifically, a plurality of forming teeth 17 is provided, said teeth being homogeneously distributed following a circumferential line at the outlet opening 11. Each forming tooth 17 acts in abutment relationship with the conductor 2, directly on the outer surface of same, or on the inner coating layer 7 previously applied thereto.

Consequently, during moving forward of the conductor 2 each tooth 17 retains a portion of the self-repairing material corresponding to a respective interruption region 5.

On the opposite side from the conductor 2, each tooth 17 has at least one conveying surface 18 converging towards the conductor 2 in the feeding direction of the latter and delimiting, in the first application devices 12, an application channel 19 intended to bring part of the polymeric coating material fed to the feed duct 13 to the respective interruption region 5. Consequently, in each of the interruption regions 5 a respective anchoring portion 6 is formed concurrently with formation of the inner coating sheath 3, by use of part of the polymeric material flowing along the feed duct 13 of the application devices 12.

Alternatively, it may be provided that to the conductor 2 entering the guide head 9 is previously applied, by an extrusion process for example, the inner coating 7 already provided with outer longitudinal ribs adapted to define the interruption portions 6. In this case the extrusion tip 16 could have a circular outlet or in any case an outlet devoid of any forming teeth 17, so as to remove the self-repairing material in excess from the radially outer surfaces of said ribs, causing application of the self-repairing material itself exclusively to the inner coating layer 7, in each of the spaces defined between two contiguous ribs.

To produce anchoring portions 6 with a section of trapezoidal shape (according to the preferred embodiment described above), each tooth 17 and the corresponding application channel 19 are configured with angled side walls to impart said trapezoidal shape to the resulting anchoring portions 6.

Figure 5:
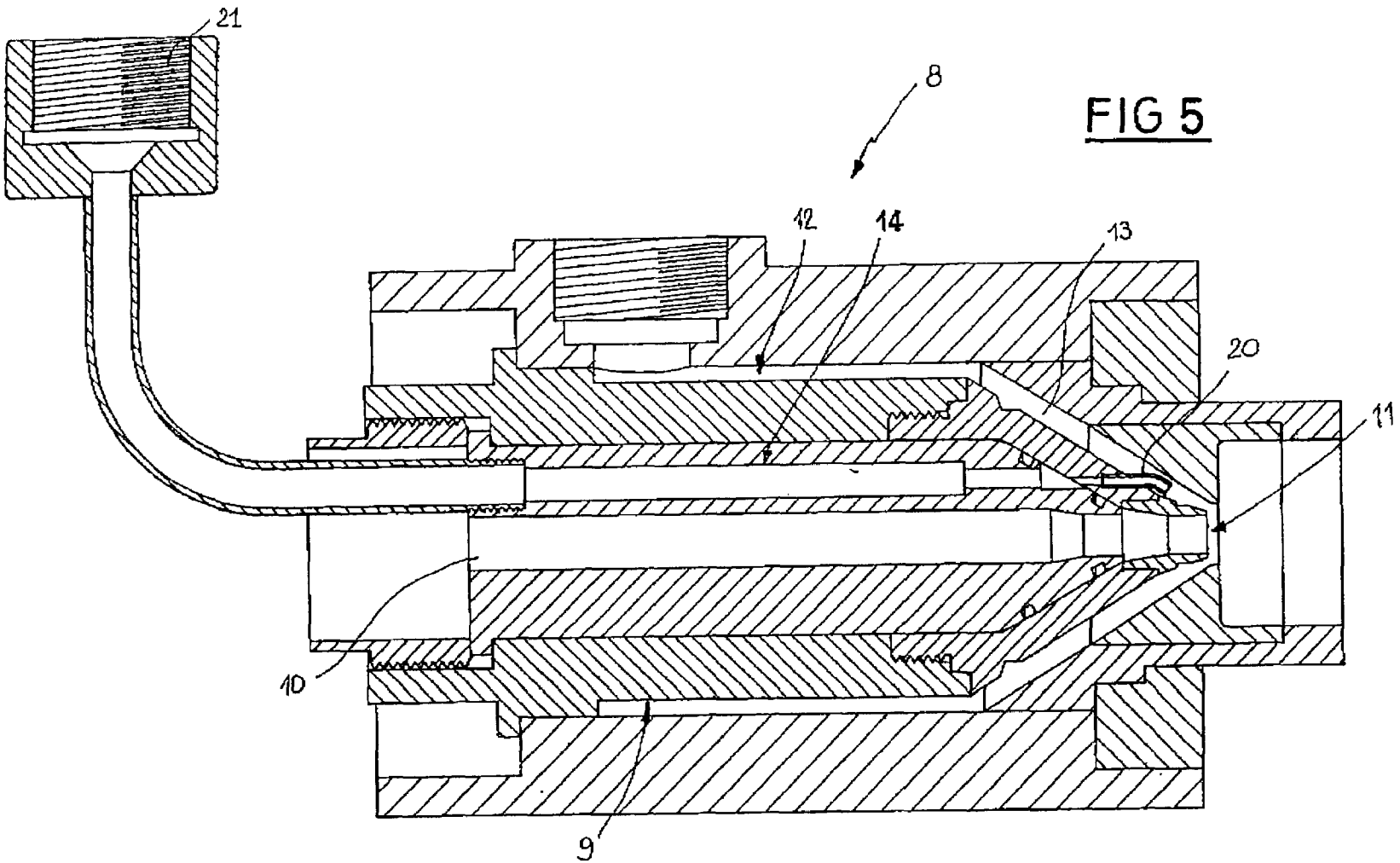
FIG. 5 is a longitudinal section of an apparatus for manufacturing the electrical cable shown in FIG. 2.

Shown in FIG. 5 is an alternative version of apparatus 8, arranged to manufacture electrical cables 1 in accordance with the embodiment shown in FIG. 2.

In this case the second application devices 14 comprise one or more distributing nozzles 20 fed with self-repairing material from a tank (not shown in the figure) connected with a fitting 21 and operatively associated with the first application devices 12 for injecting the self-repairing material itself into the polymeric coating material flowing through the feed duct 13 towards the outlet opening so as to form the outer coating sheath 3 together with the anchoring portions 6 and the optional inner coating layer 7.

The distributing nozzles 20 are circumferentially arranged around the conductor 2 and are consecutively spaced apart from each other so as to form a self-repairing material layer 4 having a plurality of interruption regions 5 disposed as shown in FIG. 2.

The outer coating sheath 3, the layer of self-repairing material 4, the interconnection portions 6 and the optional inner coating layer 7 are simultaneously applied to the conductor 2 moving through the outlet opening 11, possibly provided with an additional coating previously applied thereto.

By suitably selecting the number, size and position of the distributing nozzles 20, the number and size of the anchoring portions 6 can be suitable managed, as well as the thickness of the optional inner coating layer 7.

In particular, by positioning the distributing nozzles 20 close to the conductor 2, either elimination of the inner coating layer 7 may be achieved, or a very reduced thickness may be conferred to said coating layer, thus manufacturing a cable similar to that shown in FIG. 1.

The present invention achieves important advantages. In fact, the presence of the self-repairing layer ensures a perfect functionality of the cable even when the outer coating sheath 3 and/or the inner coating layer 7 are accidentally damaged; in addition, the self-repairing layer keeps its physical-chemical features unchanged independently of treatments and/or damages to which the cable is submitted.

Furthermore, arrangement of the anchoring portions 6 eliminates any possibility of the outer sheath 3 sliding relative to the conductor 2. In particular, any risk of sliding is prevented which may be caused by inner stresses induced in the coating sheath as a result of cooling taking place after the extrusion step carried out in the manner described above for cable manufacturing. It is to be noted that sliding actions triggered by said inner stresses usually reveal themselves in a particularly evident manner just during installation of the cable, when the latter is unwound from the packaging reel and cut into pieces of the desired length.

Due to the presence of the anchoring portions, holding of the conductor at a position perfectly concentric with the cable is also ensured, even when the cable is submitted to bending. In addition, a substantial evenness in the thickness of the self-repairing material layer is also ensured.

The invention claimed is:

1. A method of manufacturing electrical cables with self-repairing protection, comprising:

externally applying an outer coating sheath around at least one conductor;

applying at least one layer of self-repairing material between the conductor itself and the outer coating sheath;

forming at least one interruption region in the extension of said layer of self-repairing material; and disposing at least one anchoring portion between the conductor and the outer coating sheath at said interruption region.

2. The method of claim 1, wherein said interruption region of the extension of the self-repairing material layer is formed by removing part of the self-repairing material distributed around the conductor.

3. The method of claim 2, wherein a plurality of said interruption regions homogenously distributed around the conductor is formed, a plurality of anchoring portions being disposed each at one of said interruption regions.

4. The method of claim 1, wherein during the step of applying said self-repairing material layer, the self-repairing material layer is directly applied to the conductor and during the step of arranging said at least one anchoring portion, the at least one anchoring portion is directly placed on the conductor.

5. The method of claim 1, further comprising, before the step of applying the self-repairing material layer, applying at least one inner coating layer to the conductor.

6. The method of claim 5, wherein during the step of applying said self-repairing material layer, the self-repairing material layer is put directly into contact with the inner coating layer and during the step of disposing said at least one anchoring portion, the at least one anchoring portion is put directly into contact with said inner coating layer.

7. The method of claim 1, wherein said at least one anchoring portion is put directly into contact with said outer coating sheath.

8. The method of claim 1, wherein the steps of applying said at least one anchoring portion and applying said outer coating sheath are performed simultaneously, using the same material, to define one single body circumscribing the conductor.

9. The method of claim 5, wherein said inner coating layer, said at least one anchoring portion and said outer coating sheath are made of one and the same coating material in the form of a unitary body.

* * * * *